US012013162B2

(12) United States Patent
Wang et al.

(10) Patent No.: US 12,013,162 B2
(45) Date of Patent: Jun. 18, 2024

(54) CONTROL CIRCUIT, SIGNAL CONVERSION CIRCUIT AND CONTROL METHOD

(71) Applicant: Infineon Technologies Austria AG, Villach (AT)

(72) Inventors: Yao Wang, Suzhou (CN); Hanjie Yin, Shaanxi (CN)

(73) Assignee: Infineon Technologies Austria AG, Villach (AT)

( * ) Notice: Subject to any disclaimer, the term of this patent is extended or adjusted under 35 U.S.C. 154(b) by 377 days.

(21) Appl. No.: 17/480,023

(22) Filed: Sep. 20, 2021

(65) Prior Publication Data

US 2022/0090835 A1 Mar. 24, 2022

(30) Foreign Application Priority Data

Sep. 21, 2020 (CN) ..... 202010995753.6

(51) Int. Cl.
*F25B 49/02* (2006.01)

(52) U.S. Cl.
CPC ..... *F25B 49/022* (2013.01); *F25B 2600/025* (2013.01)

(58) Field of Classification Search
CPC ..... F25B 49/022; F25B 2600/025
USPC ..... 327/47
See application file for complete search history.

(56) References Cited

U.S. PATENT DOCUMENTS 5,809,085 A * 9/1998 Goodson ..... H03D 1/06 455/308
2006/0017518 A1* 1/2006 Wilcox ..... H03B 5/368 331/185
2011/0235368 A1* 9/2011 Khan ..... H02M 7/217 363/16
2014/0173314 A1* 6/2014 Min ..... G06F 1/3206 713/323
2015/0204594 A1* 7/2015 Luo ..... F25B 49/022 62/115
2016/0094025 A1* 3/2016 Smith ..... H02H 3/105 323/271
2020/0132319 A1* 4/2020 Kim ..... F24F 1/00075

* cited by examiner

*Primary Examiner* — Tomi Skibinski
(74) *Attorney, Agent, or Firm* — Murphy, Bilak & Homiller, PLLC

(57) ABSTRACT

A control circuit, a signal conversion circuit and a control method are disclosed. The control circuit includes a controller, which controls a load circuit according to a received input signal; and an enable module, which is connected to the controller and enables the controller on the basis of a frequency of the input signal, wherein the controller is caused to be in an operational state so as to control the load circuit according to the input signal when the frequency is higher than a predetermined threshold, and the controller is caused to be in a sleep state and thus not control the load circuit according to the input signal when the frequency is lower than the predetermined threshold.

20 Claims, 9 Drawing Sheets

Capacitor C3 (waveform (3)): maximum value 1.00781 V; minimum value 549.479 mV; effective value 754.431 mV

CONTROL CIRCUIT, SIGNAL CONVERSION CIRCUIT AND CONTROL METHOD

TECHNICAL FIELD

The content of the present disclosure relates to the field of electronic circuits, in particular to the reduction of circuit power consumption.

BACKGROUND

In applications such as refrigerators, a compressor driver board is controlled by a variable-frequency signal. When there is no variable-frequency signal, or when the frequency of the variable-frequency signal is too low, the compressor will stop operating. At present, the standby power consumption of driver boards is generally 0.5 Watts or even 0.3 Watts. However, as the demand for low power consumption becomes ever higher, manufacturers wish to further reduce the standby power consumption of driver boards.

FIG. 1 shows a typical variable-frequency signal input circuit for supplying a signal to an IO (input/output) port of a microcontroller unit (MCU). As shown in FIG. 1, a variable-frequency signal is inputted to the IO port of the MCU via an optocoupler U3 and a filter circuit formed by R2 and C2. A power supply input terminal Vcc of the MCU is connected to a +5V or +3.3V power supply and an output end OUT of a low-dropout regulator (LDO). A capacitor C1 is connected between the output end OUT of the LDO and ground. An input end IN of the LDO is connected to a power supply. Based on the received variable-frequency signal, the MCU controls a compressor driver board, thereby controlling an electric machine rotation speed. Table 1 below illustrates typical frequency-speed characteristics.

TABLE 1

| Signal frequency fn (Hz) | Electric machine speed n (rpm) |
|---|---|
| $f_n < 30$ | Stop |
| $30 \leq f_n < 40$ | Minimum speed |
| $40 \leq f_n < 150$ | $30 \times f_n$ |
| $150 \leq f_n < 200$ | Maximum speed |
| $f_n \geq 200$ | Stop |

It can be seen from Table 1 that when the frequency of the variable-frequency signal is lower than 30 Hz, the electric machine stops rotating. However, although the electric machine stops operating when the frequency is lower than 30 Hz, the MCU used to control the driver board still operates.

SUMMARY

A brief summary of the content of the present disclosure is given below, in order to furnish a basic understanding of certain aspects of said content. It should be understood that this summary is not an exhaustive summary of said content. It is not intended to determine key or important parts of said content, nor is it intended to define the scope of said content. Its aim is merely to set out certain concepts in simplified form, to serve as an introduction to the more detailed description that will be discussed later.

According to one embodiment, a control circuit is provided, comprising: a controller, which controls a load circuit according to a received input signal; and an enable module, which is connected to the controller and enables the controller on the basis of a frequency of the input signal, wherein the controller is caused to be in an operational state so as to control the load circuit according to the input signal when the frequency is higher than a predetermined threshold, and the controller is caused to be in a sleep state and thus not control the load circuit according to the input signal when the frequency is lower than the predetermined threshold.

Preferably, the enable module comprises: an input unit, which receives the input signal; a switch unit, which outputs an enable signal via an output end; a voltage conversion unit, an enable terminal of the voltage conversion unit being connected to the output end of the switch unit so as to receive the enable signal, and an output terminal of the voltage conversion unit being connected to a power supply input terminal of the controller; and a switch control loop, which is connected between the input unit and the switch unit, and controls the switching of the switch unit ON and OFF on the basis of a frequency of the input signal, wherein the switch unit is caused to be ON when the frequency is lower than the predetermined threshold.

Preferably, the switch control loop comprises a charging/discharging loop; the charging/discharging loop comprises a first resistor and a first capacitor connected in series, wherein one end of the first resistor is connected to the input unit, and the first capacitor is connected between a control terminal of the switch unit and ground.

Preferably, the switch control loop comprises a charging branch and a discharging branch; the charging branch comprises a first resistor and a first capacitor connected in series, wherein one end of the first resistor is connected to the input unit, and the first capacitor is connected between a control terminal of the switch unit and ground, and wherein the discharging branch comprises a second resistor and a diode, wherein the second resistor has one end connected to the input unit and another end connected to a cathode of the diode, and an anode of the diode is connected to the control terminal of the switch unit.

Preferably, the output end of the switch unit is connected to a power supply via a third resistor, and a third terminal of the switch unit is connected to ground.

Preferably, the enable module further comprises a Zener diode, a cathode of the Zener diode being connected to the input unit and being further connected to a power supply via a fourth resistor, and an anode of the Zener diode being connected to ground.

Preferably, the input signal is a variable-frequency signal.

According to another embodiment, a signal conversion circuit is provided, comprising: an input unit, which receives a first signal; a switch unit, which outputs a second signal via an output end; and a switch control loop, which is connected between the input unit and the switch unit, and controls the switching of the switch unit ON and OFF on the basis of a frequency of the first signal, wherein a controller coupled to the output end of the switch unit is caused to be in an operational state or a sleep state according to whether the frequency of the first signal is higher than or lower than a predetermined threshold.

Preferably, the controller controls a load circuit according to the first signal when in the operational state, and does not control the load circuit according to the first signal when in the sleep state.

Preferably, the controller is coupled to the signal conversion circuit via a voltage conversion unit, the output end of the switch unit is connected to an enable input terminal of the voltage conversion unit, and an output terminal of the voltage conversion unit is connected to a power supply input terminal of the controller.

Preferably, the signal conversion circuit further comprises a Zener diode, a cathode of the Zener diode being connected to the input unit and being further connected to a power supply via a fourth resistor, and an anode of the Zener diode being connected to ground.

Preferably, the first signal is a variable-frequency signal, and the second signal is an enable signal.

According to another embodiment, a control method is provided, comprising: receiving an input signal; converting the input signal to an enable signal by means of the signal conversion circuit; receiving the enable signal from the output end of the switch unit of the signal conversion circuit by means of a voltage conversion unit; and by means of the voltage conversion unit, based on a level of the enable signal, causing a controller connected to the voltage conversion unit to be in an operational state so as to control a load circuit according to the input signal, or to be in a sleep state and thus not control the load circuit according to the input signal.

The embodiments enable a reduction in the standby power consumption of a controller such as an MCU.

These and other advantages will become more obvious through the following detailed description of embodiments in conjunction with the drawings.

BRIEF DESCRIPTION OF THE DRAWINGS

In order to further expound the above and other advantages and features of the content of the present disclosure, particular embodiments of said content are explained in further detail below in conjunction with the drawings. The drawings are included in this specification together with the detailed explanation below, and form part of this specification. Elements having identical functions and structures are represented using identical reference labels. It should be understood that these drawings merely describe typical examples of the content of the present disclosure, and should not be regarded as limiting the scope of said content. In the drawings.

DETAILED DESCRIPTION

Demonstrative embodiments of the present disclosure are described below in conjunction with the drawings. For clarity and conciseness, this specification does not include a description of all features of actual embodiments. However, it should be understood that in the process of developing any such actual embodiment, it is necessary to make many embodiment-specific decisions in order to achieve the specific objectives of the developer, for example to meet those limiting conditions that are related to the system and service, and these limiting conditions might vary somewhat from embodiment to embodiment. Additionally, it should also be understood that although development work might be very complex and time-consuming, to a person skilled in the art who benefits from the content of the present disclosure, such development work is merely a routine task.

Another point which needs to be explained here is that to avoid obscuring the present disclosure with unnecessary details, the drawings only show device structures and/or processing steps that are closely related to the solution according to the present disclosure, omitting other details that are not particularly relevant to the present disclosure.

A control circuit according to an embodiment is described below in conjunction with FIG. 2.

Figure 2:
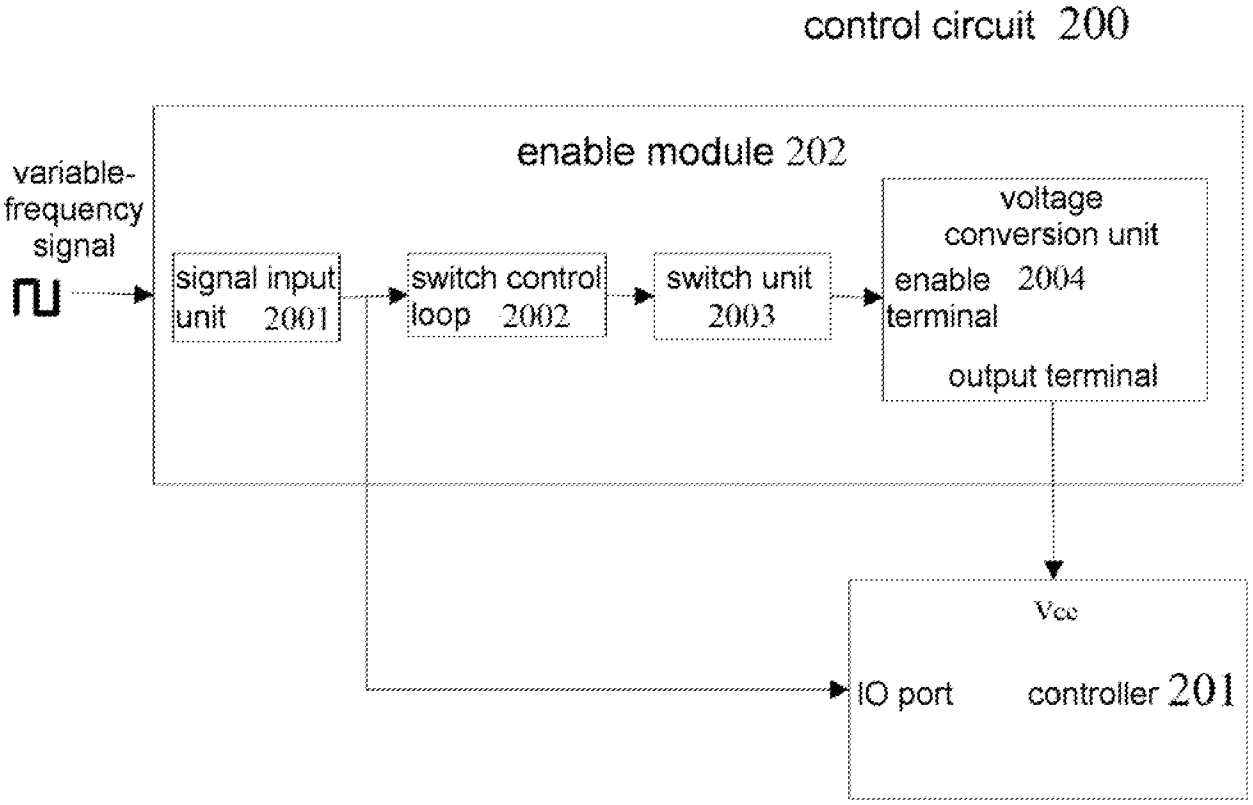
FIG. 2 shows a schematic block diagram of a control circuit according to an embodiment.

As shown in FIG. 2, the control circuit 200 comprises a controller 201 and an enable module 202. The enable module 202 is connected to the controller 201, and causes the controller 201 to enter an operational state or sleep state according to the frequency of an inputted variable-frequency signal. Specifically, when the frequency of the variable-frequency signal is higher than a predetermined threshold such as 30 Hz, the controller 201 is caused to enter the operational state by supplying a predetermined voltage such as +3.3V/5V to the controller 201, and when the frequency of the variable-frequency signal is lower than the predetermined threshold, the controller 201 is caused to enter the sleep state by supplying a voltage lower than the predetermined voltage to the controller 201, wherein, in the operational state, the controller 201 controls a load circuit according to the frequency of the variable-frequency signal, and in the sleep state, the controller 201 does not control the load circuit.

In this embodiment, the enable module 202 comprises a signal input unit 2001, a switch control loop 2002, a switch unit 2003 and a voltage conversion unit 2004. An output end of the switch unit 2003 is connected to an enable terminal of the voltage conversion unit 2004, and an output end of the voltage conversion unit 2004 is connected to a power supply input terminal Vcc of the controller 201. An IO port of the controller 201 is further connected to an output end of the signal input unit 2001.

It should be understood that the structure of the enable module 202 described above is merely exemplary, and the embodiments described herein are not limited to this, as long as it can perform the function of enabling the controller 201 according to the frequency of an input signal.

In the control circuit 200 shown in FIG. 2, when the frequency of the inputted variable-frequency signal is higher than the predetermined threshold such as 30 Hz, the switch control loop 2002 causes the switch unit 2003 to be in an OFF state continuously, and therefore the switch unit 2003 outputs a HIGH level enable signal to the enable terminal of the voltage conversion unit 2004, such that the output terminal of the voltage conversion unit 2004 outputs the predetermined voltage such as +3.3V/5V to the Vcc terminal of the controller 201. The Vcc terminal of the controller 201 receives the predetermined voltage and enters the operational state. In the operational state, the controller 201 controls the load circuit (not shown) according to the frequency of the variable-frequency signal.

Figure 1:
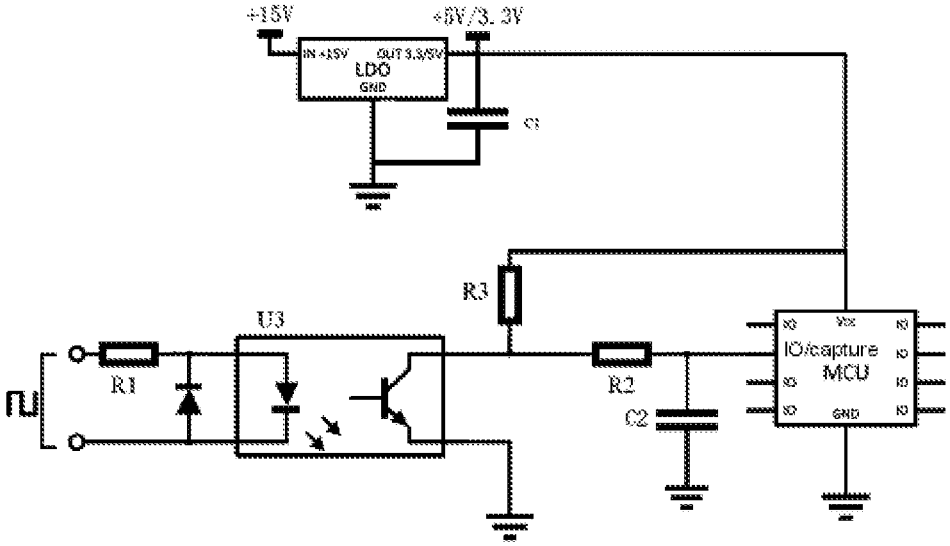
FIG. 1 shows a typical variable-frequency signal input circuit for supplying a signal to an IO port of an MCU.

When the frequency of the variable-frequency signal is lower than the predetermined threshold, the switch control loop 2002 causes the switch unit 2003 to switch continuously between ON and OFF. When the switch unit 2003 is OFF, the enable terminal of the voltage conversion unit 2004 receives a HIGH level enable signal and outputs the predetermined voltage, at which time, due to the fact that the capacitor C1 shown in FIG. 1 is charged simultaneously, the Vcc terminal of the controller 201 can only receive a voltage lower than the predetermined voltage. When the switch unit 2003 is ON, the enable terminal of the voltage conversion unit 2004 receives a LOW level enable signal and outputs zero voltage. Thus, when the frequency of the variable-frequency signal is lower than the predetermined threshold, the controller 201 is in the sleep state continuously.

It should be understood that although positive logic enabling is used in this embodiment, negative logic enabling instead may be used.

It should also be understood that the predetermined threshold mentioned above is not limited to 30 Hz, and the predetermined voltage mentioned above is not limited to +3.3V/5V; they may be set to other values according to design needs.

It should also be understood that by setting suitable circuit device parameters, it is possible to avoid a situation in which the controller 201 enters the operational state when the voltage conversion unit 2004 outputs the predetermined voltage due to the capacitor C1 being charged to a saturation state, when the frequency of the variable-frequency signal is low.

Figure 3:
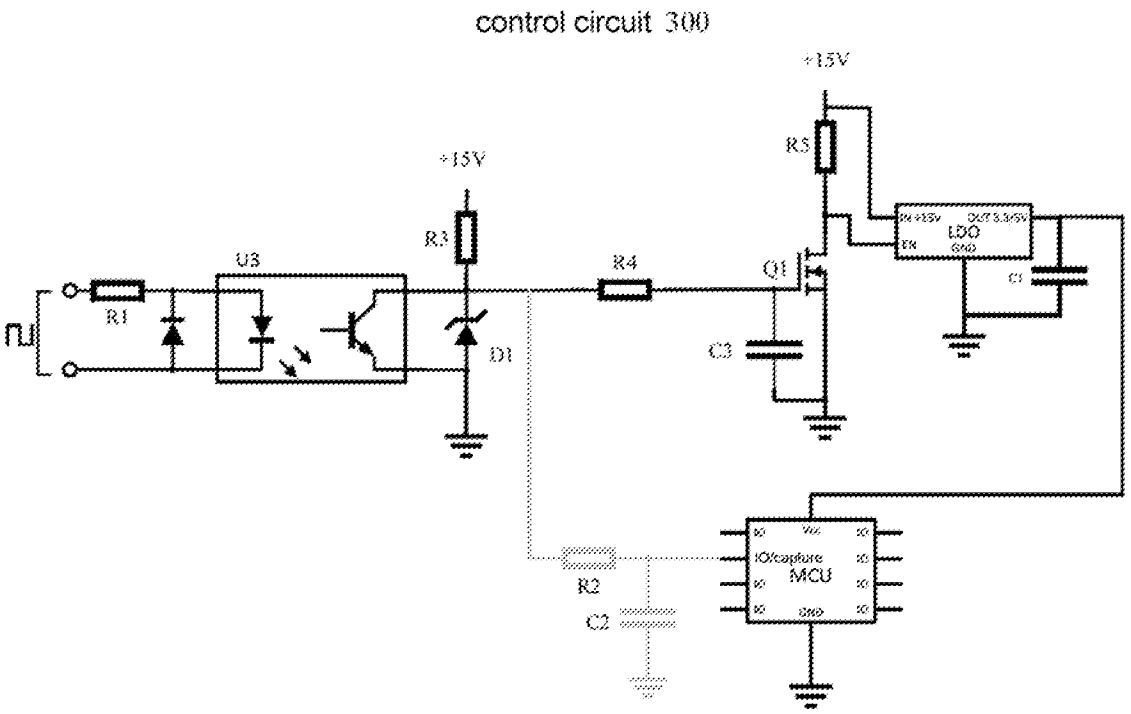
FIG. 3 shows a detailed circuit diagram of a control circuit according to an embodiment.

FIG. 3 is a detailed circuit diagram of a control circuit 300 according to an embodiment. As shown in FIG. 3, an optocoupler U3 is used as the input unit 2001 for the variable-frequency signal as in FIG. 2; a collector of a diode thereof is connected via a resistor R3 to a power supply such as +15V, and an emitter is connected to ground. A node between series-connected and grounded R4 and C3 is connected to the gate of a transistor Q1, and forms the switch control loop 2002 of FIG. 2 for the transistor Q1. An LDO is used as the voltage conversion unit 2004 of FIG. 2, and an MCU is used as the controller 201 of FIG. 2. A power supply input terminal IN of the LDO is connected to a +15V power supply, an enable terminal EN is connected to the drain of the transistor Q1, and an output terminal OUT is connected to a Vcc terminal of the MCU. An IO port of the MCU is further connected to an output end of the optocoupler U3 via a filter circuit formed by R2 and C2.

It should be understood that in this embodiment, although the optocoupler U3 is used as the input unit, another suitable input unit may be used or an input unit may not be used.

It should also be understood that although the LDO is used as the voltage conversion unit in this embodiment, any other suitable DC-DC voltage converter may be used.

Furthermore, in order to prevent the voltage inputted to the IO port of the MCU from exceeding a maximum safe voltage, a Zener diode D1 is further provided at the output end of the optocoupler U3, with the cathode thereof connected to the collector of the diode of the optocoupler U3 and the anode connected to the emitter and ground, so that the voltage at the cathode of the Zener diode D1 is stable. In this embodiment, the voltage stabilization value of D1 is for example (but is not limited to) +3.3V/5V.

Figure 5A:
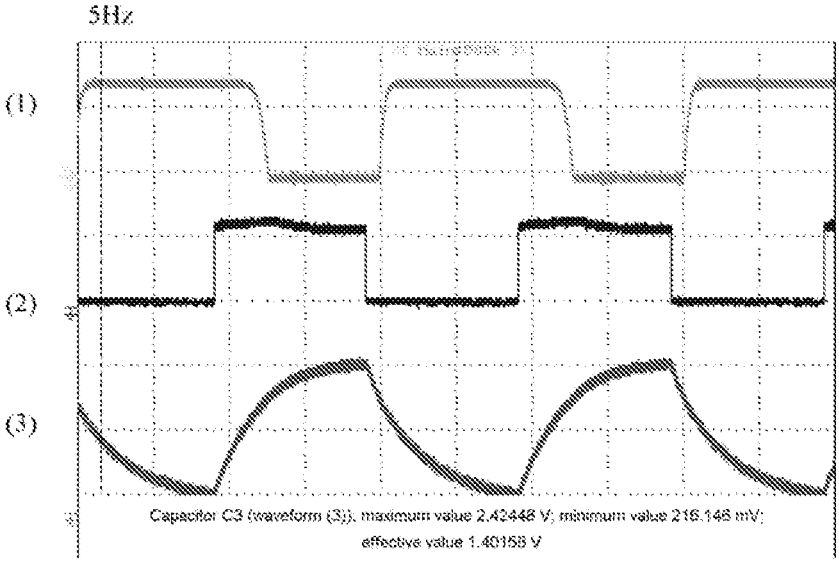
FIG. 5A is an oscilloscope screenshot of waveforms of an input signal, an enable signal and a gate signal in the control circuit shown in FIG. 3, when the input signal frequency is 5 Hz.
Figure 5B:
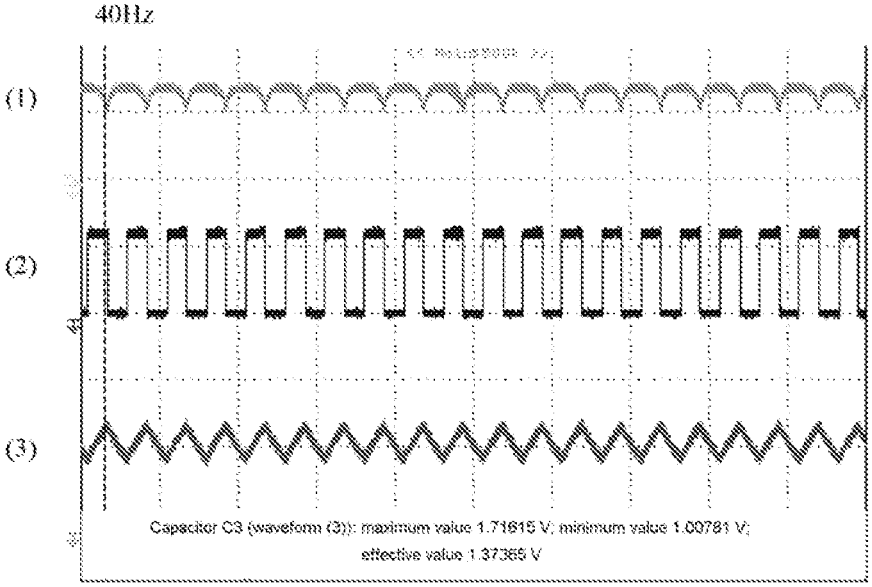
FIG. 5B is an oscilloscope screenshot of waveforms of the input signal, enable signal and gate signal of the control circuit shown in FIG. 3, when the input signal frequency is 40 Hz.

FIGS. 5A and 5B are oscilloscope screenshots of the waveforms of an enable signal (1), an input signal (2) from the output end of the optocoupler U3 and a gate signal (3) of the transistor Q1, when the frequency of the input signal is 5 Hz and 40 Hz respectively. The principle of operation of the control circuit 300 shown in FIG. 3 is explained below in conjunction with FIGS. 5A and 5B.

In this embodiment, when the frequency of the input signal is greater than a predetermined threshold such as 30 Hz, e.g. in the 40 Hz scenario of FIG. 5B, the capacitor C3 cannot be charged to the saturation state because the charging/discharging cycle is too short, so the transistor Q1 is in the OFF state continuously, as shown by the signal waveform (3) for the gate of the transistor Q1 in FIG. 5B. At this time, due to the fact that the drain of the transistor Q1 is connected via the resistor R5 to the power supply such as +15V, the enable terminal EN of the LDO receives a HIGH level enable signal from the drain of the transistor Q1, as shown by the waveform (1) of the enable signal received by the enable terminal EN of the LDO in FIG. 5B. When the HIGH level enable signal is received, the LDO outputs a predetermined voltage such as +3.3V/5V to the Vcc terminal of the MCU from the output terminal OUT, and the predetermined voltage causes the MCU to enter the operational state. In the operational state, the IO terminal of the MCU receives the variable-frequency signal from the output end of the optocoupler U3 via the filter circuit formed by R2 and C2, and controls a load circuit according to the frequency of the signal.

When the frequency of the input signal is less than the predetermined threshold, e.g. in the 5 Hz scenario of FIG. 5A, the capacitor C3 charges for an increased length of time and is thus able to be charged to the saturation state and attain the switch-on threshold of the transistor Q1. As shown by the waveform (3) of the gate signal of the transistor Q1 and the waveform (1) of the enable signal received by the enable terminal EN of the LDO in FIG. 5A, when the transistor Q1 is ON, the enable terminal EN of the LDO receives a LOW level enable signal and zero voltage is outputted; when the transistor Q1 is OFF, the enable terminal EN of the LDO receives a HIGH level enable signal and the predetermined voltage is outputted. Due to the fact that the predetermined voltage outputted by the LDO also simultaneously charges the capacitor C1, the voltage received by the Vcc terminal of the MCU is lower than the predetermined voltage, so the operational state cannot be entered. Thus, when the input signal frequency is less than the predetermined threshold, the MCU is continuously in the sleep state in which the load circuit is not controlled according to the frequency of the input signal.

The control circuit 300 according to this embodiment enables the MCU to enter the sleep state when the frequency of the input signal is lower than the predetermined threshold, thereby reducing standby power consumption.

It should be understood that the predetermined threshold of 30 Hz and the predetermined voltage of +3.3V/5V as described above are merely exemplary. Those skilled in the art can select different values appropriately according to actual needs.

Figure 4:
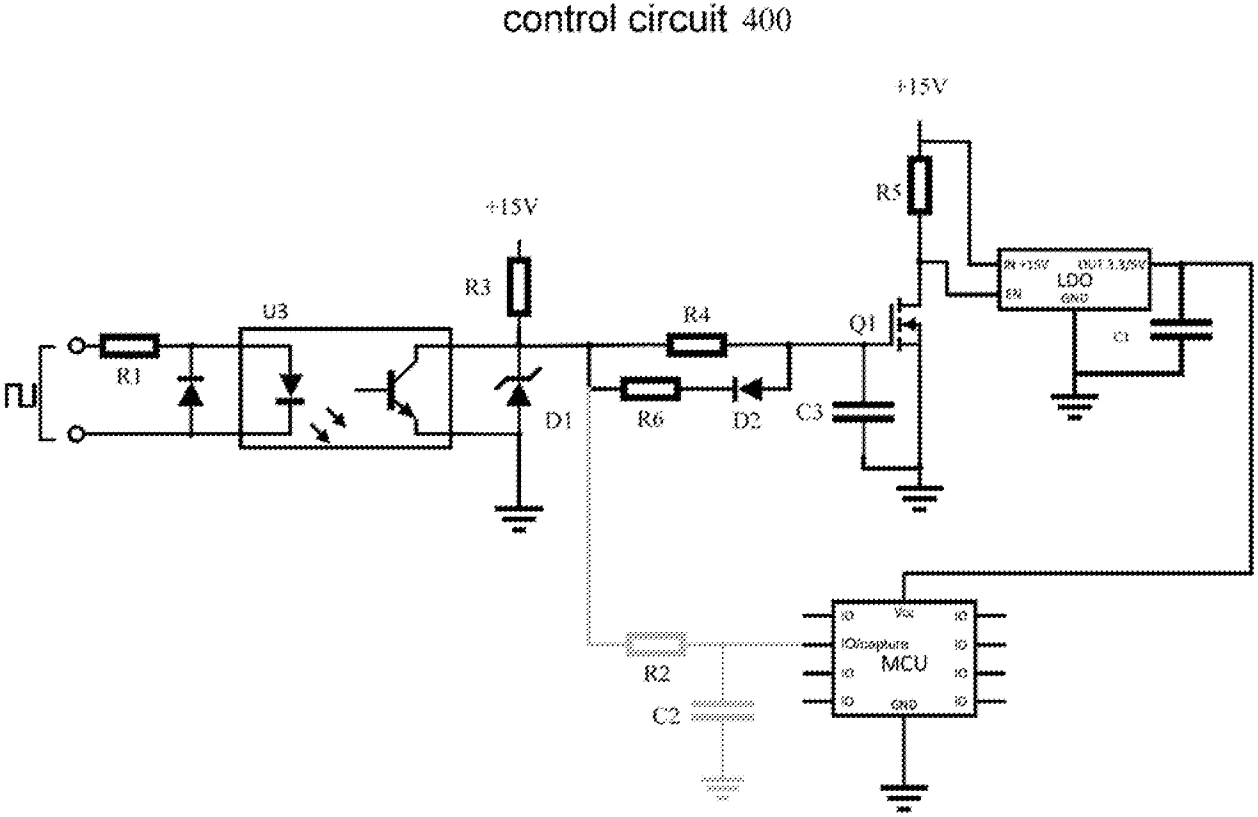
FIG. 4 shows a detailed circuit diagram of a control circuit according to another embodiment.

As is known, the switch-on threshold of the transistor will fall as the temperature rises, and this will result in a drop in performance of the control circuit 300 shown in FIG. 3. FIG. 4 shows a control circuit 400 according to another embodiment, which is capable of remedying this defect.

The structure of the control circuit 400 shown in FIG. 4 is essentially the same as that in FIG. 3, except that a resistor R6 and a diode D2 are added, being connected in parallel with the resistor R4. The resistor R6 and diode D2 are connected in series, and the anode of the diode D2 is connected to the gate of the transistor Q1. The resistor R6 and diode D2 form a discharge branch for the capacitor C3. By setting the resistance of R6 to be less than the resistance of R4, the discharging of the capacitor C3 is accelerated so as to reduce the voltage of the capacitor C3, thereby remedying the adverse effect caused by a fall in the transistor switch-on threshold due to a rise in temperature.

It should be understood that the principle of operation of the control circuit 400 shown in FIG. 4 is essentially the same as that of the control circuit 300 shown in FIG. 3, so is not described again here in order to avoid redundancy.

Figure 6A:
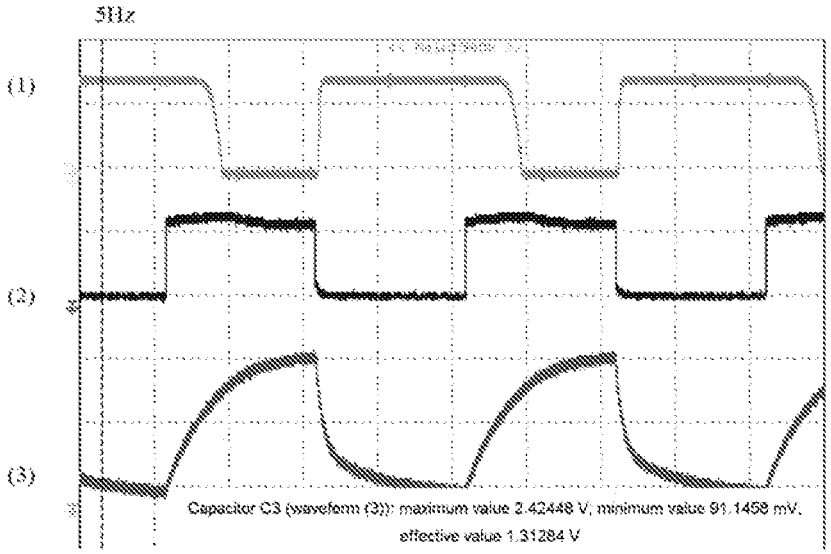
FIG. 6A is an oscilloscope screenshot of waveforms of an input signal, an enable signal and a gate signal of the control circuit shown in FIG. 4, when the input signal frequency is 5 Hz.
Figure 6B:
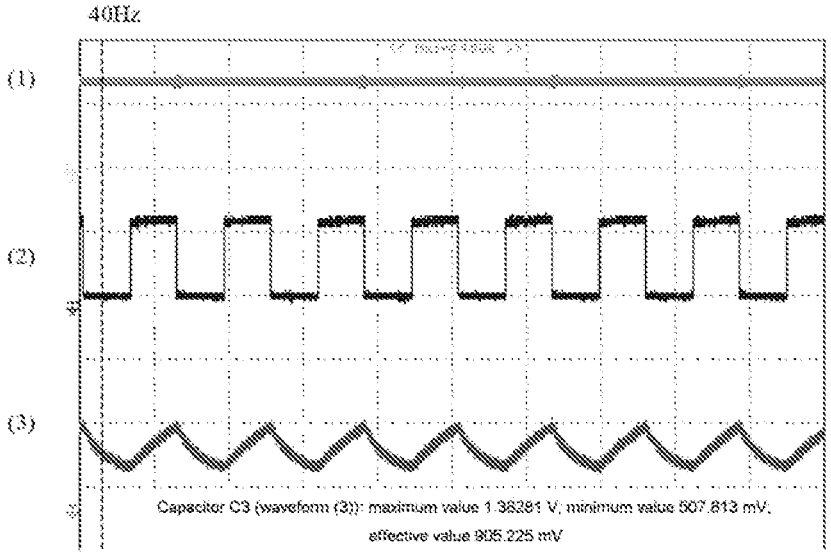
FIG. 6B is an oscilloscope screenshot of waveforms of the input signal, enable signal and gate signal of the control circuit shown in FIG. 4, when the input signal frequency is 40 Hz.

FIGS. 6A and 6B are oscilloscope screenshots of the waveforms of an enable signal (1) received by the enable terminal EN of the LDO, an input signal (2) from the output end of the optocoupler U3 and a gate signal (3) of the transistor Q1 in the control circuit 400 shown in FIG. 4, when the frequency of the input signal is 5 Hz and 40 Hz respectively. By comparing these with FIGS. 5A and 5B, it can be seen that when the input signal frequency is 40 Hz, the maximum value and effective value of the gate capacitance (capacitor C3) of the control circuit 400 shown in FIG. 4 are both reduced somewhat compared with the control circuit 300 shown in FIG. 3, thus effectively avoiding the problem caused by a fall in the transistor switch-on threshold due to a rise in temperature.

Figure 7:
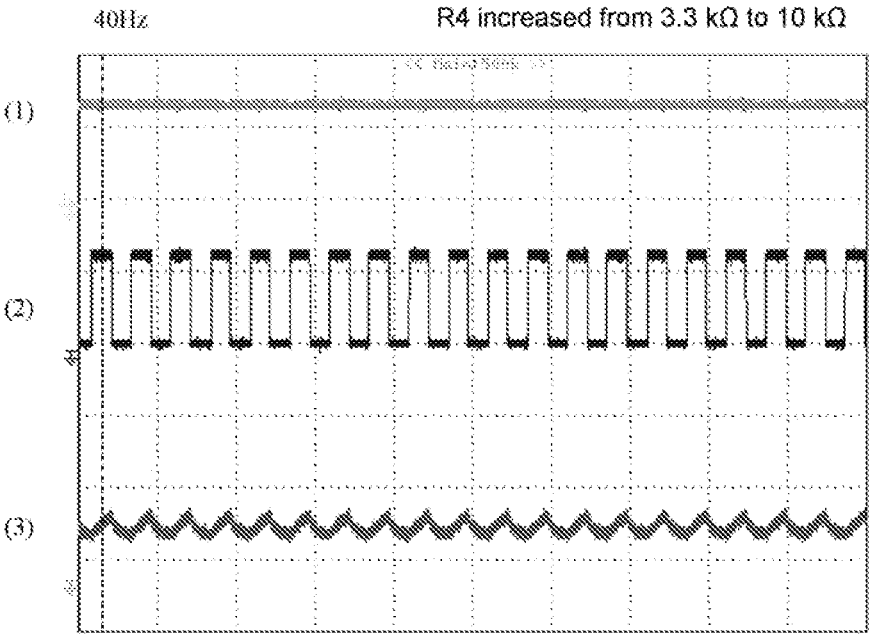
FIG. 7 is an oscilloscope screenshot of waveforms of the input signal, enable signal and gate signal of the control circuit shown in FIG. 3, when the input signal frequency is 40 Hz and the resistance of R4 is increased from 3.3 kΩ to 10 kΩ.
Figure 8:
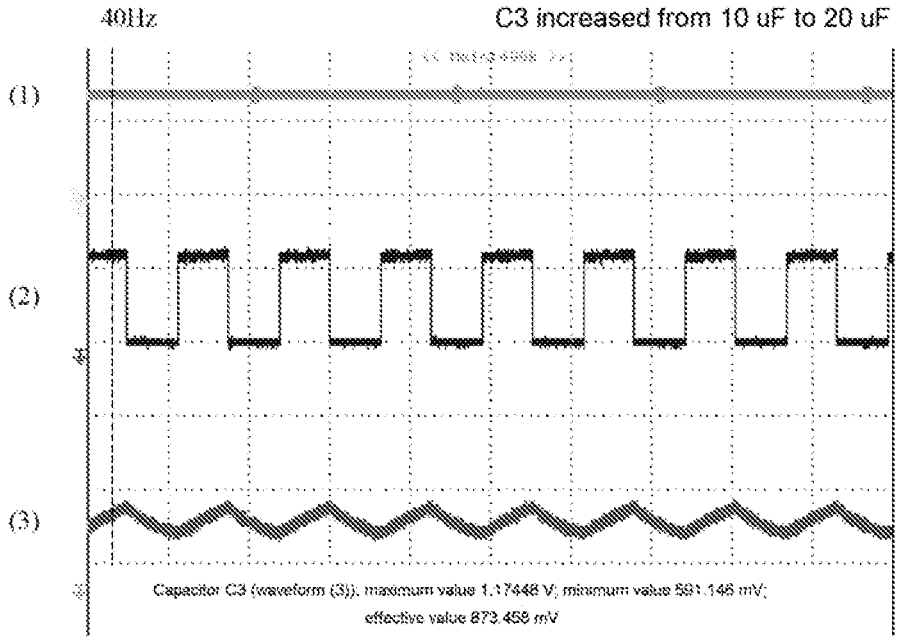
FIG. 8 is an oscilloscope screenshot of waveforms of the input signal, enable signal and gate signal of the control circuit shown in FIG. 4, when the input signal frequency is 40 Hz and the capacitance of C3 is increased from 10 uF to 20 uF.

It should be understood that the resistance of the resistor R4 or the capacitance of the capacitor C3 could also be increased to alleviate the problem of the transistor switch-on threshold voltage falling due to a rise in temperature. FIGS. 7 and 8 show waveform diagrams in these two scenarios, wherein FIG. 7 is an oscilloscope screenshot of waveforms of the enable signal (1), the input signal (2) and the gate signal (3) of the control circuit 300 shown in FIG. 3 when the input signal frequency is 40 Hz and the resistance of R4 is increased from 3.3 kΩ to 10 kΩ; and FIG. 8 is an oscilloscope screenshot of waveforms of the enable signal (1), the input signal (2) and the gate signal (3) of the transistor Q1 of the control circuit 400 shown in FIG. 4 when the input signal frequency is 40 Hz and the capacitance of C3 is increased from 10 uF to 20 uF. It can be seen from the figures that when FIG. 7 is compared with FIG. 5B and FIG. 8 is compared with FIG. 6B, the maximum value and effective value of the gate capacitance C3 are both somewhat reduced.

The control circuits which are described above in conjunction with FIGS. 2-8 effectively reduce the power consumption of the controller.

It should be pointed out that although the transistor Q1 is shown as a metal oxide semiconductor field effect transistor (MOSFET) in FIGS. 3 and 4, any other type of transistor capable of performing the same function may be used, for example but not limited to a field effect transistor (FET), a junction field effect transistor (JFET), a double-gate MOSFET, an insulated gate bipolar transistor (IGBT), etc. Examples of MOSFETs can include but are not limited to a P-type metal oxide semiconductor (PMOS), an N-type metal oxide semiconductor (NMOS), a double-diffused metal oxide semiconductor (DMOS) or any other type of MOSFET.

A signal conversion circuit (not shown) may also be used. The signal conversion circuit may comprise the signal input unit 2001, the switch control loop 2002 and the switch unit 2003 in the control circuit 200 shown in FIG. 2, and may be implemented on the basis of the detailed circuit diagrams of FIGS. 3 and 4.

Figure 9:
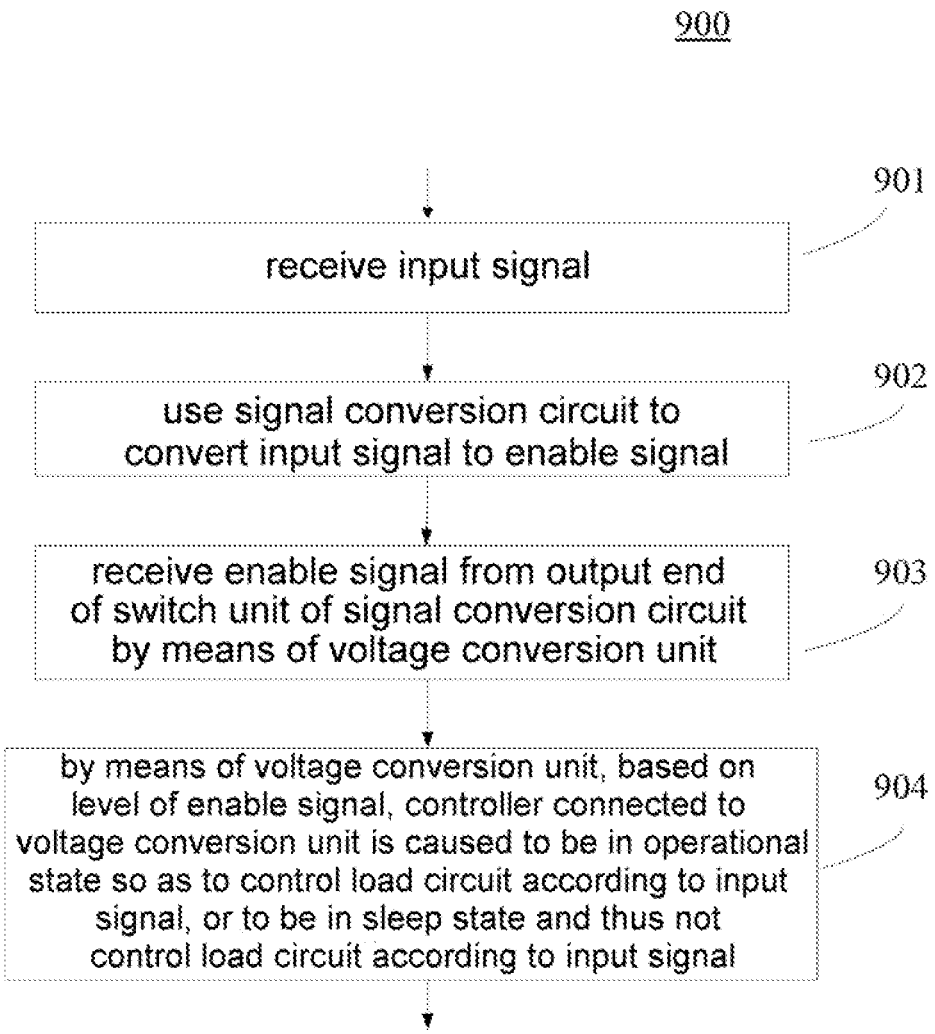
FIG. 9 is a flow chart of a control method according to an embodiment.

FIG. 9 is a flow chart of a control method 900 according to an embodiment. It should be pointed out that in this embodiment, the method 900 of FIG. 9 may be implemented using the abovementioned signal conversion circuit.

First of all, in step 901, an input signal is received. In this embodiment, the input signal is a variable-frequency signal and is received from the output end of the optocoupler U3 in the control circuit 300 or 400.

Next, in step 902, the abovementioned signal conversion circuit is used to convert the input signal to an enable signal.

Next, in step 903, the enable signal is received from the output end of the switch unit of the signal conversion circuit by means of the voltage conversion unit. Specifically, in this embodiment, the enable signal is received from the drain of the transistor Q1 via the enable terminal EN of the LDO.

Finally, in step 904, by means of the voltage conversion unit, based on the level of the enable signal, the controller connected to the voltage conversion unit is caused to be in the operational state so as to control the load circuit according to the input signal, or to be in the sleep state and thus not control the load circuit according to the input signal. Specifically, in this embodiment, the LDO outputs the predetermined voltage or outputs zero voltage to the Vcc terminal of the MCU according to the level of the enable signal received. The MCU enters the operational state of controlling the load circuit according to the frequency of the variable-frequency signal if it receives the predetermined voltage, and enters the sleep state if it receives zero voltage.

Although embodiments of the present invention have been described above in conjunction with the drawings, it should be understood that the embodiments described above are merely configured to illustrate the present invention without limiting it. Those skilled in the art could make various amendments and changes to the embodiments above without deviating from the substance and scope of the present invention. Thus, the scope of the present invention is defined only by the attached claims and equivalent meaning thereof.

What is claimed is:

1. A control circuit, comprising:

a controller configured to control a load circuit according to a received input signal; and an enable module connected to the controller and configured to enable the controller based on a frequency of the input signal, wherein the controller is configured to be in an operational state to control the load circuit according to the input signal when the frequency is higher than a predetermined threshold, wherein the controller is configured to be in a sleep state and to not control the load circuit according to the input signal when the frequency is lower than the predetermined threshold.

2. The control circuit of claim 1, wherein the enable module comprises:

an input unit configured to receive the input signal;

a switch unit configured to output an enable signal via an output end;

a voltage conversion unit having an enable terminal connected to the output end of the switch unit to receive the enable signal, and an output terminal of the voltage conversion unit connected to a power supply input terminal of the controller; and a switch control loop connected between the input unit and the switch unit, and configured to control a switching of the switch unit ON and OFF based on a frequency of the input signal, wherein the switch unit is configured to be ON when the frequency is lower than the predetermined threshold.

3. The control circuit of claim 2, wherein the switch control loop comprises a charging/discharging loop.

4. The control circuit of claim 3, wherein the charging/discharging loop comprises a first resistor and a first capacitor connected in series, wherein one end of the first resistor is connected to the input unit, and wherein the first capacitor is connected between a control terminal of the switch unit and ground.

5. The control circuit of claim 2, wherein the switch control loop comprises a charging branch and a discharging branch.

6. The control circuit of claim 5, wherein the charging branch comprises a first resistor and a first capacitor connected in series, one end of the first resistor being connected to the input unit, and the first capacitor being connected between a control terminal of the switch unit and ground, and wherein the discharging branch comprises a second resistor and a diode, the second resistor having one end connected to the input unit and another end connected to a cathode of the diode, and an anode of the diode being connected to the control terminal of the switch unit.

7. The control circuit of claim 2, wherein the output end of the switch unit is connected to a power supply via a third resistor, and a third terminal of the switch unit is connected to ground.

8. The control circuit of claim 2, wherein the enable module further comprises a Zener diode, a cathode of the Zener diode being connected to the input unit and being further connected to a power supply via a fourth resistor, and an anode of the Zener diode being connected to ground.

9. The control circuit of claim 1, wherein the input signal is a variable-frequency signal.

10. A signal conversion circuit, comprising:

an input unit configured to receive a first signal;

a switch unit configured to output a second signal via an output end; and a switch control loop connected between the input unit and the switch unit, and configured to control a switching of the switch unit ON and OFF based on a frequency of the first signal, wherein a controller coupled to the output end of the switch unit is configured to be in an operational state or a sleep state according to whether the frequency of the first signal is higher than or lower than a predetermined threshold.

11. The signal conversion circuit of claim 10, wherein the controller is configured to control a load circuit according to the first signal when in the operational state, and to not control the load circuit according to the first signal when in the sleep state.

12. The signal conversion circuit of claim 11, wherein the switch control loop comprises a charging/discharging loop.

13. The signal conversion circuit of claim 12, wherein the charging/discharging loop comprises a first resistor and a first capacitor connected in series, wherein one end of the first resistor is connected to the input unit, and wherein the first capacitor is connected between a control terminal of the switch unit and ground.

14. The signal conversion circuit of claim 11, wherein the switch control loop comprises a charging branch and a discharging branch.

15. The signal conversion circuit of claim 14, wherein the charging branch comprises a first resistor and a first capacitor connected in series, one end of the first resistor being connected to the input unit, and the first capacitor being connected between a control terminal of the switch unit and ground, and wherein the discharging branch comprises a second resistor and a diode, the second resistor having one end connected to the input unit and another end connected to a cathode of the diode, and an anode of the diode being connected to the control terminal of the switch unit.

16. The signal conversion circuit of claim 10, wherein the output end of the switch unit is connected to a power supply via a third resistor, and wherein a third terminal of the switch unit is connected to ground.

17. The signal conversion circuit of claim 10, wherein the controller is coupled to the signal conversion circuit via a voltage conversion unit, wherein the output end of the switch unit is connected to an enable input terminal of the voltage conversion unit, and wherein an output terminal of the voltage conversion unit is connected to a power supply input terminal of the controller.

18. The signal conversion circuit of claim 10, further comprising a Zener diode, a cathode of the Zener diode being connected to the input unit and being further connected to a power supply via a fourth resistor, and an anode of the Zener diode being connected to ground.

19. The signal conversion circuit of claim 10, wherein the first signal is a variable-frequency signal, and wherein the second signal is an enable signal.

20. A control method, comprising:

receiving an input signal via an input unit;

converting the input signal to an enable signal at an output end of a switch unit, wherein a switch control loop is connected between the input unit and the switch unit;

receiving the enable signal from the output end of the switch unit of the signal conversion circuit at a voltage conversion unit; and by the voltage conversion unit, and based on a level of the enable signal, causing a controller connected to the voltage conversion unit to be in an operational state to control a load circuit according to the input signal, or to be in a sleep state and to not control the load circuit according to the input signal.

* * * * *